US005367913A

United States Patent [19]

Yumiyama et al.

[11] Patent Number: 5,367,913

[45] Date of Patent: Nov. 29, 1994

[54] PINION SHIFT DEVICE FOR STARTER AND ASSEMBLY METHOD OF THE SAME

[75] Inventors: Shigeru Yumiyama, Katsuta; Hideo Mori, Ibaraki, both of Japan

[73] Assignee: Hitachi, Ltd., Tokyo, Japan

[21] Appl. No.: 932,946

[22] Filed: Aug. 21, 1992

[30] Foreign Application Priority Data

Aug. 21, 1991 [JP] Japan ..... 3-209469

[51] Int. Cl.[5] ..... F02N 15/06

[52] U.S. Cl. ..... 74/7 A; 29/434; 29/453; 184/5; 184/100; 403/353

[58] Field of Search ..... 74/7 A; 29/434, 453; 184/5, 100; 403/353

[56] References Cited

U.S. PATENT DOCUMENTS 4,579,010 4/1986 Colvin et al. ..... 74/7 A
4,995,275 2/1991 Okamoto et al. ..... 184/5

FOREIGN PATENT DOCUMENTS 62-56350 11/1987 Japan .
63-21362 1/1988 Japan .
63-129165 6/1988 Japan .
63-44945 9/1988 Japan .
63-215873 9/1988 Japan .

*Primary Examiner*—Allan D. Herrmann
*Attorney, Agent, or Firm*—Evenson, McKeown, Edwards & Lenahan

[57] ABSTRACT

In a pinion shift device for a starter of the type employing a semicircular ring-shaped shift plate, the device is constructed such that the shift plate is easily assembled to a shift lever to be suitable for automatization, slide contact portions between the clutch body and the shift plate and/or between the shift flange and the shift plate are less subjected to overflow or exhaustion of grease and give rise to a smaller extent of wear, and thus service life of the device is prolonged. A semicircular ring-shaped portion of the shift plate is loosely fitted in an axial gap between a clutch body and a shift flange integral with a clutch sleeve. A recessed groove for storing grease therein is provided in at least one of paired opposite side faces between the semicircular ring-shaped portion of the shift plate and the clutch body as well as the shift flange. The shift lever and the shift plate are both molded using resin. Mutually fitting portions of the shift plate and the shift lever are constituted by projections and holes. Sloped surfaces serving as assembling guides are respectively formed in each end face of the projection and each side face around the hole.

15 Claims, 5 Drawing Sheets

PINION SHIFT DEVICE FOR STARTER AND ASSEMBLY METHOD OF THE SAME

FIELD OF THE INVENTION

The present invention relates to a starter for starting up an engine, and more particularly to a pinion shift device for a starter in which a pinion is shifted through a shift lever toward a ring gear for meshing therewith, as well as an assembly method of the pinion shift device.

BACKGROUND OF THE INVENTION

A pinion shift device for a starter generally comprises a unidirectional clutch having a clutch body and a clutch sleeve which is integral with the clutch body and slidably fitted over an output shaft of an electric motor, and a shift lever which is swingably supported at its intermediate portion and has a two-forked portion. The shift lever pushes the clutch sleeve to move in the axial direction so that the pinion is brought into mesh with a ring gear of an engine.

The prior art relating to interconnection between the two-forked portion of the shift lever and the clutch sleeve in such a pinion shift device is known as follows. JP, B, 63-44945 discloses the arrangement that a shift flange is provided on the clutch sleeve while forming an axial gap between the clutch body and the shift flange, and the two-forked portion of the shift lever is directly loosely fitted in the axial gap. JP, A, 63-129165 discloses the arrangement that a semicircular ring-shaped shift plate is pivotably coupled to an end of the two-forked portion of the shift lever and the shift plate is loosely fitted in the axial gap between the clutch body and the shift flange. JP, B, 62-56350 discloses the arrangement that a circular ring-shaped shift plate is pivotably coupled to the end of the two-forked portion of the shift lever and the shift plate is inserted in the axial gap between the clutch body and the shift flange. In the case of using the shift plate, a pin or a screw is used as means for pivotably coupling the shift plate to the shift lever. Additionally, in the device disclosed in the above-cited JP, B, 62-56350, the shift lever and the shift plate are both molded using resin.

Further, relating to the prior art in which the two-forked portion of the shift lever is directly loosely fitted in the axial gap between the clutch body and the shift flange, JP, A, 63-215873, JP, A, 63-21362, etc. disclose the arrangement that the shift lever is molded using resin and a recessed groove for accumulating grease therein is formed in a slide contact portion of the resin-made shift lever with the clutch sleeve.

SUMMARY OF THE INVENTION

As explained above, the conventional pinion shift devices are divided into the type employing the shift plate (JP, A, 63-129165 and JP, B, 62-56350) and the type not employing the shift plate (JP, B, 63-44945, JP, A, 63-215873 and JP, A, 63-21362). Of the devices using the shift plate, there are those employing the circular ring-shaped shift plate (JP, B, 62-56350) and those employing the semicircular ring-shaped shift plate (JP, A, 63-129165).

The devices of the type not using the shift plate require the two-forked portion of the shift lever, which is moved in a swingable manner, to be directly loosely fitted in the axial gap between the clutch body and the shift flange, meaning that the axial gap becomes long. Therefore, the devices of the type using the shift plate are superior to the other devices from the standpoint of reducing the size.

Meanwhile, of the devices using the shift plate, the type employing the circular ring-shaped shift plate requires the circular ring-shaped shift plate to be inserted in the axial gap between the clutch body and the shift flange. Accordingly, the clutch sleeve and the shift flange are constituted as separate parts from each other, which not only increases the number of parts, but also raises difficulties in the operation of assembling the shift plate to the clutch sleeve. From this point of ease in assembly of the shift plate, the type employing the semicircular ring-shaped shift plate is superior to the other type.

In any devices of the type using the shift plate, however, because of a pin or a screw being used as means for pivotably coupling the shift plate to the shift lever, difficulties are encountered in the operation of assembling the shift plate to the two-forked portion of the shift lever in a pivotable manner.

Furthermore, in the devices of the type using the shift plate, no considerations is given to the fact that the pinion rotates at a high speed since it is shifted by the shift lever toward a ring gear for meshing with the same and, immediately thereafter, an engine is started up, and that grease coated on the shift plate is subjected to a high-temperature atmosphere and is overflown or exhausted depending on the direction in which the starter is mounted. This causes another problem in that slide contact portions between the clutch body and the shift plate and between the shift flange and the shift plate undergo a large extent of wear.

A first object of the present invention is to provide a pinion shift device for a starter of the type employing a semicircular ring-shaped shift plate, in which a shift plate is easily coupled to a shift lever.

A second object of the present invention is to provide a pinion shift device for a starter of the type employing a semicircular ring-shaped shift plate, in which slide contact portions between the clutch body and the shift plate and/or between the shift flange and the shift plate are less subjected to overflow or exhaustion of grease and give rise to a smaller extent of wear, this has the result of prolonging the service life.

A third object of the present invention is to provide a method of assembling a pinion shift device for a starter of the type employing a semicircular ring-shaped shift plate, which enables components to be easily assembled and is suitable for automatization.

To achieve the above first object, in accordance with the present invention, there is provided a pinion shift device for a starter comprising a unidirectional clutch having a clutch body and a clutch sleeve being integral with said clutch body and slidably fitted over an output shaft of an electric motor, a shift lever is swingably supported at its intermediate portion and has a two-forked portion the shift lever pushes the clutch sleeve to move in the axial direction so that the pinion is brought into mesh with a ring gear of an engine, the pinion shift device further comprises (a) a shift flange provided on the clutch sleeve to define an axial gap between the clutch body and the shift flange; (b) a semicircular ring-shaped shift plate loosely fitted in the axial gap; (c) fitting means including a projection and a hole provided on the two-forked portion of the shift lever and the shift plate and pivotably connecting the shift plate to ends of the two-forked portion; and (d) at least one sloped surface formed as an assembling guide in the fitting means to function as a guide when the shift plate is fitted to the ends of the two-forked portion.

With the above arrangement, when coupling the shift plate and the shift lever to each other, the shift plate is pressed into the shift lever until the projection is accommodated in the hole with the sloped surfaces serving as guides, while sliding an end face of the projection of the fitting means along a side face around the hole, in a first position resulted by turning the shift plate 180 degrees from a position where the shift plate is loosely fitted in the axial gap between the shift flange and the clutch body. At this time, because the end face of the projection is pressed to slide along the side face around the hole while being guided by the respective sloped surfaces, the shift plate and the two-forked portion are elastically deformed so that the projection and the hole are easily fitted to each other to interconnect the shift plate and the shift lever. Further, the shift plate and the two-forked portion return of themselves to their original shapes after the fitting, resulting in the structure that both the components will never be disconnected. After coupling the shift plate and the two-forked portion to each other in this manner, the shift plate is turned 180 degrees from the first position to assume a second position. While keeping the second position, the shift plate is then loosely fitted in the axial gap between the shift flange and the clutch body, thereby completing assembly of the pinion shift device.

In the above pinion shift device, preferably, the sloped surface is formed in each of an end face of the projection and a side face around the hole.

Also preferably, the sloped surface in the end face of the projection and the sloped surface in the side face around the hole are formed to incline in the same direction in a position (first position) resulted by turning the shift plate 180 degrees from a position (second position) where the shift plate is loosely fitted in the axial gap between the shift flange and the clutch body, but in opposite directions in said loosely fitted position (second position). With this arrangement, the length through which the projection and the hole are fitted with each other in the second position, i.e., in the loosely fitted position, is increased to enable more positive fitting therebetween.

Further preferably, at least one of the two-forked portions of the shift lever and the shift plate is molded using resin. Thereby, when the end face of the projection is pressed to slide along the side face around the hole while being guided by the respective sloped surfaces, the shift plate and the shift lever are elastically deformed so easily, because resin has a relatively large degree of elasticity, that the operation of fitting the projection and the hole to each other is further facilitated.

To achieve the above second object, in accordance with the present invention, there is provided a pinion shift device for a starter comprising a unidirectional clutch having a clutch body and a clutch sleeve being integral with said clutch body and slidably fitted over an output shaft of an electric motor, a shift lever is swingably supported at its intermediate portion and has a two-elasticity, forked portion, said shift lever pushing the clutch sleeve to move in the axial direction so that the pinion is brought into mesh with a ring gear of an engine, the pinion shift device further comprises (a) a shift flange provided on the clutch sleeve to define an axial gap between the clutch body and the shift flange; (b) a semicircular ring-shaped shift plate pivotably connected to ends of the two-forked portion of the shift lever and loosely fitted in the axial gap; and (c) lubricating means provided in at least one of paired opposite side faces between the semicircular ring-shaped shift plate and the clutch body as well as the shift flange to store a lubricant therein.

With the above arrangement, by providing the lubricating means in at least one of the paired opposite side faces between the semicircular ring-shaped shift plate and the clutch body as well as the shift flange, when the pinion is rotated at a high speed while the shift plate is pushing the pinion to come into mesh with the ring gear of the engine, the lubricant stored in the lubricating means lubricates the sliding portions of the paired opposite side faces and suppress the progress of wear. Also, since the side face opposite the lubricating means serves as a lid, the lubricant is less subjected to over-flow or exhaustion and thus service life of the pinion shift device can be prolonged to a large extent.

In the above pinion shift device, preferably, the shift plate is molded using resin and the lubricating means includes at least one recessed groove formed in the shift plate. This enables the recessed groove to be formed at the same time as the molding of the shift plate, whereby the lubricating means is easily formed. Further, a large amount of lubricant can be stored because it is filled in the recessed groove.

Also preferably, the recessed groove has a semicircular ring shape in conformity with the side face of the shift plate. This enables a still larger amount of lubricant to be stored.

To achieve the above third object, in accordance with the present invention, there is provided a method of assembling a pinion shift device for a starter comprising a unidirectional clutch having a clutch body. A clutch sleeve is integral with the clutch body and slidably fits over an output shaft of an electric motor. A shift flange is provided on the clutch sleeve to define an axial gap between the clutch body and the shift flange. A shift lever is swingably supported at its intermediate portion and has a two-forked portion. A semicircular ring-shaped shift plate is pivotably connected to ends of the two-forked portion of the shift lever and loosely fits in the axial gap. The shift lever pushes the clutch sleeve to move in the axial direction through the shift flange so that the pinion is brought into mesh with a ring gear of an engine. The method comprises the steps of: (a) preparing, as the shift lever and the shift plate, a shift lever and a shift plate that have fitting means including a projection and a hole adapted to pivotably connect the shift lever and the shift plate to each other at the ends of the two-forked portion of the shift lever and also have at least one sloped surface formed as an assembling guide in the fitting means; (b) pressing the shift plate into the shift lever until the projection is accommodated in the hole under guide of the sloped surface, while sliding an end face of the projection along a side face around the hole, in a first position resulted by turning the shift plate 180 degrees from a position where the shift plate is loosely fitted in the axial gap between the shift flange and the clutch body; (c) turning the shift plate 180 degrees from the first position to a second position; and (d) loosely fitting the shift plate in the axial gap between the shift flange and the clutch body while keeping the second position.

With the present invention thus arranged, the shift plate can be coupled to the shift lever and assembled over the clutch sleeve through a relatively simple operation comprising three steps of press-fitting the shift plate into the shift lever, turning the shift plate 180 degrees from the first position, and loosely fitting the shift plate into the axial gap while keeping the shift plate at the second position. Therefore, assembly of the pinion shift device is facilitated to such an extent as to enable automatization.

Other objects, advantages and novel features of the present invention will become apparent from the following detailed description of the invention when considered in conjunction with the accompanying drawings.

DETAILED DESCRIPTION OF THE PREFERRED EMBODIMENTS

Hereinafter, a first embodiment of the present invention will be described with reference to FIGS. 1 through 4.

Figure 1:
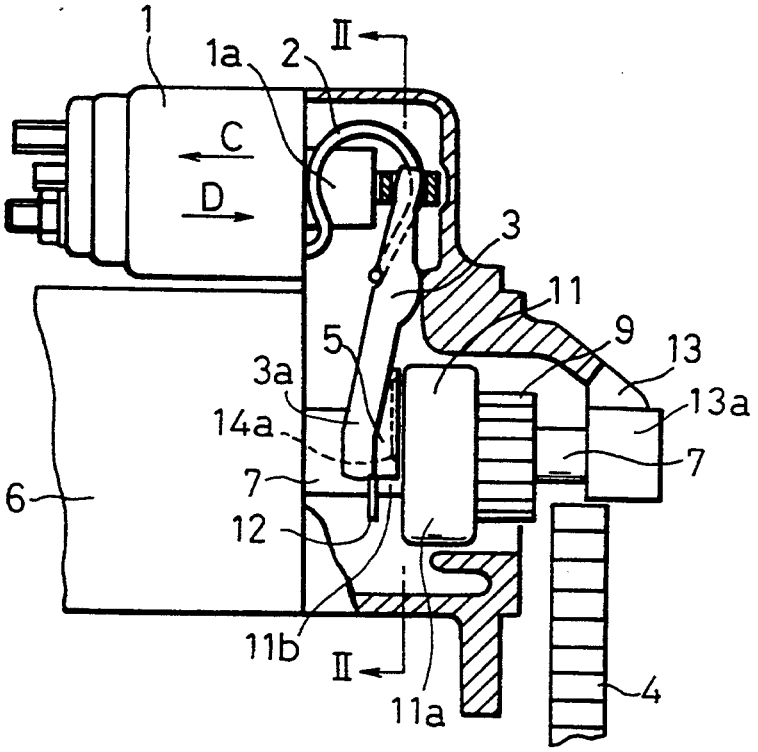
FIG. 1 is a partial sectional view of a pinion shift device for a starter according to a first embodiment of the present invention.
Figure 2:
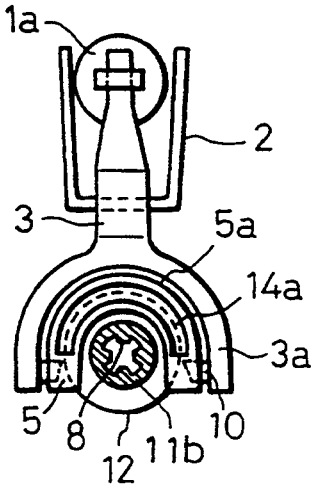
FIG. 2 is a sectional view taken along line II—II in FIG. 1.

In FIG. 1, denoted by reference numeral 1 is a solenoid switch with a plunger 1*a* incorporated therein. Engaged with a distal end of the plunger 1*a* is a bifurcated shift lever 3 supported swingably about its central portion by a press-fit spring 2. A two-forked portion 3*a* of the shift lever 3 serves to push a pinion 9 toward a ring gear 4 of an engine so that the pinion 9 and the ring gear 4 are brought into mesh with each other. Denoted by 6 is an electric motor having an output shaft 7 of which distal end is rotatably supported by a bearing 13*a* provided in a front case 13. A unidirectional clutch 11 and the pinion 9 are both mounted over the output shaft 7. The unidirectional clutch 11 comprises a clutch body 11*a*, a clutch sleeve 11*b* which is integral with the clutch body 11*a* and fitted over the output shaft 7 of the electric motor 6 through a helical spline 8, as shown in FIG. 2, in an axially movable manner, and a shift flange 12 formed at one end of the clutch sleeve 11*b* to define an axial gap between the clutch body 11*a* and the shift flange. The clutch body 11*a* is constructed to transmit rotation from the output shaft 7 of the electric motor 6 to the pinion 9 at start-up, but not transmit rotation from the pinion 9 to the output shaft 7 after start-up of the engine.

A semicircular ring-shaped shift plate 5 is pivotably connected to ends of the two-forked portion 3*a* of the shift lever 3 and is loosely fitted in the axial gap between the shift flange 12 of the clutch sleeve 11*b* and the clutch body 11*a*.

The shift lever 3 and the shift plate 5 are both molded using resin. The resin used herein should be heatresistant against the ambient temperature from −40° C. to 130° C. in which the present device is to be employed, and is prepared by adding glass fiber of 30% to nylon-base resin, for example, that is widespread as one of general engineering plastics.

Figure 3:
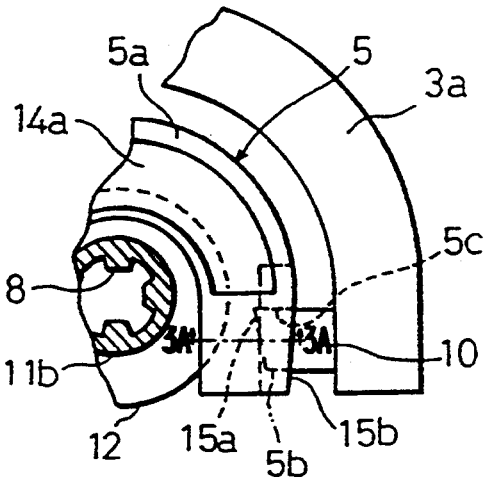
FIG. 3 is an enlarged view of principal parts of the pinion shift device shown in FIG. 1.
Figure 3A:
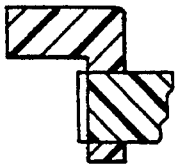
FIG. 3A is a cross-sectional view taken along line 3A—3A of FIG. 3.
Figure 4:
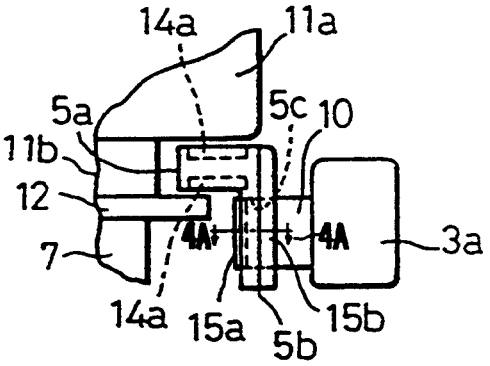
FIG. 4 is a bottom view of the pinion shift device shown in FIG. 3.
Figure 4A:
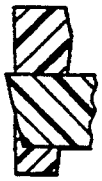
FIG. 4A is a cross-sectional view taken along line 4A—4A of FIG. 4.

FIGS. 3 and 4 show the structure of connecting the ends of the two-forked portion 3*a* of the shift lever 3 and the semicircular ring-shaped shift plate 5. At each of the ends of the two-forked portion 3*a* of the shift lever 3, there is provided a projection 10 protruding toward the shift flange 12 to be fitted with the shift plate 5. The shift plate 5 has a semicircular ring-shaped portion 5*a* loosely fitted in the axial gap between the shift flange 12 of the clutch sleeve 11*b* and the clutch body 11*a*, and a pair of boss portions 5*b* provided at base ends of the semicircular ring-shaped portion 5*a* and protruding axially on the opposite side to the clutch body 11*a*. The boss portions 5*b* are each formed with a fitting hole 5*c* and the projection 10 is inserted through the hole 5*c*, whereby the ends of the two-forked portion 3*a* of the shift lever 3 is pivotably connected to the shift plate 5 (FIGS. 3*a* and 4*a*).

Further, in opposite side faces of the semicircular ring-shaped portion 5*a* of the shift plate 5 respectively facing the clutch body 11*a* and the shift flange 12, there are defined recessed grooves 14*a* each having a semicircular ring shape in conformity with the form of the semicircular ring-shaped portion 5*a*, the recessed grooves 14*a* being filled with grease. A side wall of the clutch body 11*a* and a side wall of the shift flange 12 respectively facing the recessed grooves 14*a* double as lids for the grease.

In addition, a sloped surface 15*a* serving as an assembling guide is formed in an end face of the projection 10, while a sloped surface 15*b* serving as an assembling guide is formed in a side face of the boss portion 5*b* around the hole 5*c* on the side from which the projection 10 is to be inserted. As viewed in FIG. 3 showing a condition after assembly, the sloped surface 15*a* extends from a right lower end toward a left upper end and the sloped surface 15*b* extends from a left lower end toward a right upper end, that is to say, they are inclined in opposite relation to each other.

Operation of the above-explained pinion shift device and functions of the components will be described below.

When a key switch (not shown) is turned on under a condition that the starter is in rest as shown in FIG. 1, the plunger 1*a* in the solenoid switch 1 is moved in a direction of arrow C so that one end of the bifurcated, resin-made shift lever 3 engaging the plunger 1*a* is pulled in the direction C and the other end of the shift lever i.e., the ends of the two-forked portion 3*a* is pushed toward the ring gear 4 of the engine. More specifically, the semicircular ring-shaped, resin-made shift plate 5 which is pivotably fitted to the ends of the two-forked portion 3a abuts against the side face of the clutch body 11, pushes the clutch sleeve 11b and the clutch body 11a together with the pinion 9, and then brings the pinion 9 into abutment against the end face of the ring gear 4, thereby completing a first stage of the pinion shift operation.

When the plunger 1a is further moved in the direction C while pulling one end of the shift lever 3 and flexing the press-fit spring 2 and a return spring (not shown) built in the solenoid switch 1, to such an extent as to close a contact built in the solenoid switch 1, the electric motor 6 is energized from a battery (not shown), whereupon the output shaft 7 is rotated and this rotation is transmitted to the pinion 9 through the helical spline 8. As a result, the pinion 9 comes into mesh with the ring gear 4 to rotate the ring gear 4 and the engine is started up, thereby completing a second stage of the pinion shift operation.

Upon confirmation of start-up of the engine, the key switch is turned off and the contact built in the solenoid switch 1 is opened by an action of the return spring. Almost at the same time, the plunger 1a is retracted in a direction of arrow D so that one end of the shift lever 3 engaging the plunger 1a is pushed in the direction D and the shift plate 5 is pulled toward the electric motor 6. Therefore, the semicircular ring-shaped portion 5a of the shift plate 5 loosely fitted in the axial gap between the shift flange 12 and the clutch body 11a is brought into abutment against the shift flange 12, the pinion 9 is disengaged from the ring gear 4, and further the starter returns to the rest state shown in FIG. 1, thereby completing the pinion shift operation.

With the above-explained pinion shift operation repeated, those portions of the shift plate 5 and the shift flange 12 as well as the clutch body 11a which are loosely fitted with each other are repeatedly moved in slide contact relation. To prevent wear caused by such sliding movement, grease is usually coated on those slide-moving portions. In the prior art, however, because grease is simply coated, the coated grease is subjected to a high-temperature atmosphere and is overflown or exhausted depending on the direction in which the starter is mounted. This has raised the problem that the slide contact portions between the clutch body 11a and the shift plate 5 and between the shift flange 12 and the shift plate 5 undergo a large extent of wear. On the contrary, in this embodiment, the semicircular ring-shaped portion 5a of the shift plate 5 is formed substantially throughout each side face thereof with the recessed groove 14a having an analogous semicircular ring shape, and grease is filled in the recessed groove 14a, as explained above. Therefore, a large amount of grease can be filled. Also, owing to the arrangement that the grease is accommodated in the recessed grooves 14a and that the side wall of the clutch body 11a and the side wall of the shift flange 12 respectively facing the recessed grooves 14a double as lids for the grease, the grease is less subjected to overflow or exhaustion. As a result, it is possible to suppress wear over a longer period of time and prolong service life of the pinion shift device for the starter.

A method of assembling the shift plate 5, the shift lever 3 and the clutch sleeve 11b will now be described below with reference to FIGS. 5 through 7.

Figure 5:
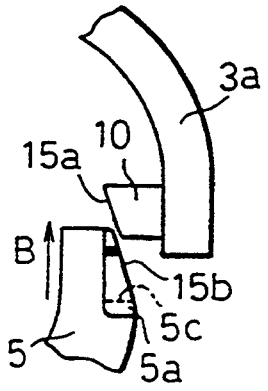
FIG. 5 is a view showing the initial stage of an assembly step for the pinion shift device shown in FIG. 1.
Figure 6:
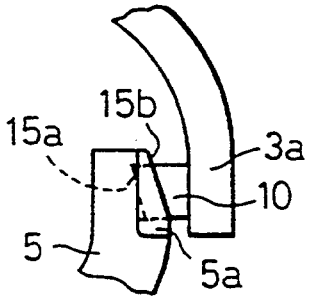
FIG. 6 is a view showing the middle stage of the assembly step for the pinion shift device shown in FIG. 1.

First, as shown in FIG. 5, under a condition that the shift plate 5 is turned 180 degrees from the position at which it is to be loosely fitted in the axial gap between the clutch body 11a and the shift flange 12, the sloped surfaces 15b of the boss portions 5b of the shift plate 5, serving as assembling guides, are positioned to align with the sloped surfaces 15a of the shift lever 3, also serving as assembling guides. Then, as shown in FIG. 6, the shift plate 5 is pressed in a direction of arrow B until the projections 10 are fitted in the respective holes 5c of the boss portions 5b. At this time, by pressing the shift plate 5 such that the end face of each projection slides along the side face around the hole 5c under guide of the sloped surfaces 15a, 15b, the shift plate 5 and the two-forked portion 3a are elastically deformed in such directions as to facilitate fitting between the projection 10 and the hole 5c, causing the projection 10 and the hole 5c to be easily fitted with each other. Here, in this embodiment, the shift lever 3 and the shift plate 5 have a relatively large degree of elasticity because of being made of resin, which enables easier press-fitting between both the components. Additionally, the shift plate 5 and the two-forked portion 3a return of themselves to their original shapes after the fitting, resulting in the structure that both the components will never be disconnected.

Figure 7:
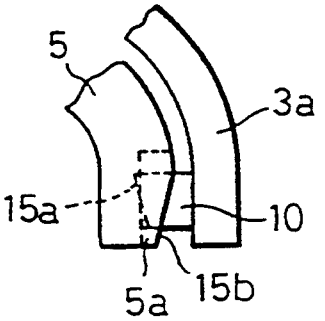
FIG. 7 is a view showing the final stage of the assembly step for the pinion shift device shown in FIG. 1.

Then, the shift plate 5 is turned 180 degrees so as to assume the loosely fitted position shown in FIG. 7. Under this condition, the shift plate 5 is assembled over the clutch sleeve 11b by being loosely fitted in the axial gap between the clutch body 11 and the shift flange 12. After the assembly, the sloped surface 15a at the end of the projection 10 and the sloped surface 15b around the hole 5c are inclined in opposite directions at the loosely fitted position. Therefore, the length through which the projection 10 and the hole 5c are fitted with each other in that loosely fitted position is so increased as to ensure the positive fitting therebetween.

With this embodiment, there are obtained several advantages described below.

Since the sloped surfaces 15a, 15b serving as assembling guides are provided in the respective fitting portions of the resin-made shift lever 3 and the resin-made shift plate 5, the shift lever 3 and the shift plate 5 can be easily assembled. The above arrangement also provides the structure that the shift plate 5 will never be disconnected from the shift lever 3 after the assembly, which results in improved reliability.

Also, since the shift plate 5 can be coupled to the shift lever 3 and assembled over the clutch sleeve 11b through a relatively simple operation comprising three steps of press-fitting the shift plate 5 into the shift lever 3, turning the shift plate 5 180 degrees from the press-fitted position, and loosely fitting the shift plate into the axial gap while keeping the shift plate at the turned position, assembly of the pinion shift device is facilitated to such an extent as to enable automatization.

Further, since grease is filled in the semicircular ring-shaped recessed grooves 14a and the side faces of the clutch body 11 and the shift flange 12 respectively facing the recessed grooves 14a serve as lids for the grease, it is possible to fill a large amount of grease and prevent the filled grease from overflowing or exhausting. As a result, the progress of sliding wear due to the repeated pinion shift operation can be suppressed over a longer period of time and service life of the pinion shift device can be prolonged.

Additionally, since grease is filled in the recessed grooves 14a and the side faces of the clutch body 11 and the shift flange 12 respectively facing the recessed grooves 14a serve as lids for the grease, overflow or exhaustion of the grease under a high-temperature atmosphere can be suppressed whatever direction the starter is mounted depending on various possible mounting directions thereof. Thus, the degree of freedom in mounting the starter can be increased.

Moreover, since the shift plate 5 is molded using resin and the recessed grooves 14*a* are formed in the resin-made shift plate 5, it is possible to form the recessed grooves 14*a* at the same as molding the shift plate, and thus facilitate formation of the recessed grooves.

Figure 8:
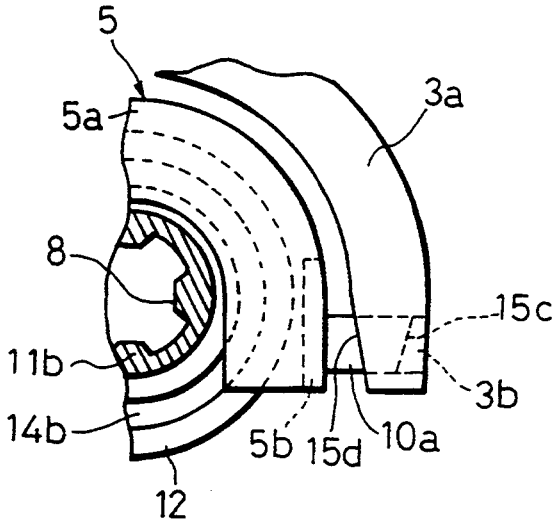
FIG. 8 is an enlarged view of principal parts of a pinion shift device for a starter according to another embodiment of the present invention.
Figure 9:
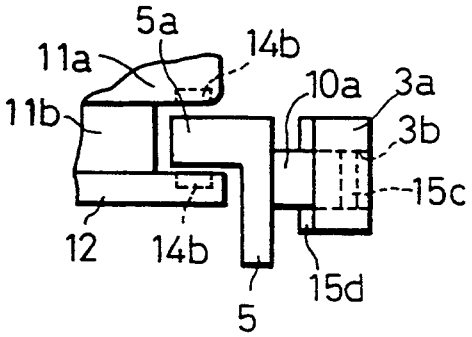
FIG. 9 is a bottom view of the pinion shift device shown in FIG. 8.

Another embodiment of the present invention is shown in FIGS. 8 and 9. In this embodiment, a fitting projection 10*a* is provided on each of the boss portions 5*b* of the shift plate 5 and a fitting hole 3*b* is defined in each of the ends of the two-forked portion 3*a* of the shift lever 3. The shift plate 5 is pivotably connected to the two-forked portion 3*a* by inserting the projection 10*a* into the hole 3*b*. A sloped surface 15*c* serving as an assembling guide is formed in an end face of the projection 10*a*, while a sloped surface 15*d* serving as an assembling guide is formed in a side face of the two-forked portion, facing the projection 10*a*, around the hole 3*b* in the end thereof. Those sloped surfaces 15*c*, 15*d* are inclined, as with the above embodiment, in opposite directions in the illustrated loosely fitted position, but in the same direction under a condition that the shift plate 5 is turned 180 degrees from the illustrated loosely fitted position. Further, annular recessed grooves 14*b* are defined in side faces of the clutch body 11 and the shift flange 12 facing the shift plate 5, and are filled with grease. With this embodiment, there can also be obtained basically similar advantages to the above embodiment.

Figure 10:
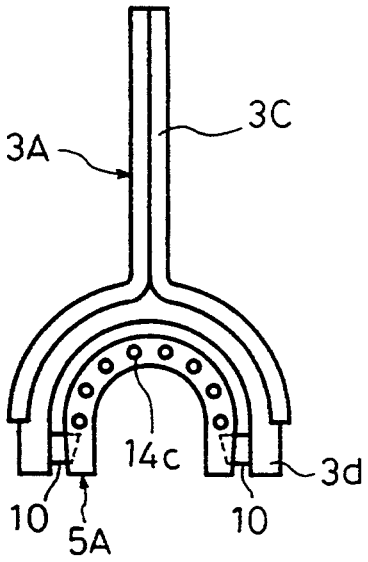
FIG. 10 is a front view of a portion of a pinion shift device, including a shift lever and a shift plate, according to still another embodiment of the present invention.

Still another embodiment of the present invention will be described below with reference to FIG. 10. This embodiment is different from the above embodiment in the material of the shift lever and the arrangement for storing grease. More specifically, in FIG. 10, a shift lever 3A of this embodiment comprises a shift lever body 3*c* made of rigid metal, e.g., steel, and a two-forked portion 3*d* molded using resin and provided integrally with the shift lever body 3*c*. On the other hand, a plurality of through holes 14*c* are bored in a shift plate 5A to store grease therein. The side wall of the clutch body 11*a* and the side wall of the shift flange 12 facing the through holes 14*c* serve as lids for the grease.

With this embodiment, the shift lever body 3*c* as a part of the shift lever 3A is made of metal, but the two-forked portion 3*d* is made of resin. Therefore, the two-forked portion 3*d* has a high degree of elasticity similarly to the two-forked portion in the above first embodiment, so that the projections 10 and the holes 5*c* can be easily fitted with each other like the above first embodiment. Additionally, the provision of the through holes 14*c* as lubricating means enables a large amount of grease to be filled like the recessed grooves in the above first embodiment. As a result, this embodiment can also provide basically similar advantages to the above first embodiment.

It should be noted that while, in the foregoing embodiments, the shift lever and the shift plate are made of resin or of the composite structure of resin and metal, these components may be both made of metal. In this case, because metal is an elastic material, the sloped surfaces 15*a*, 15*b* are likewise effective as assembly guides to facilitate the assembly operation although a little greater pressing force must be applied.

In the foregoing embodiments, the recess grooves 14*a* or 14*b* for storing grease therein are defined in both the opposite side faces of the shift plate 5 facing the clutch body 11 and the shift flange 12, or in both the side faces of the clutch body 11 and the shift flange 12 facing the shift plate 5. However, since a larger extent of sliding friction is caused between the shift plate 5 and the clutch body 11 when the pinion is pushed, the recessed groove may be formed only in the side where the shift plate 5 and the clutch body 11 are facing each other.

Additionally, while the recessed grooves or the through holes are formed as lubricating means to store grease therein, a felt material impregnated with grease may be bonded to the side face of the shift plate or the like.

According to the present invention, as has been described above, the shift lever and the shift plate can be easily assembled to facilitate automatization of the assembly operation, and the shift plate will never be disconnected from the shift lever after the assembly, with the result of achieving products of high reliability.

Also, the progress of sliding wear in the portions loosely fitting with each other can be suppressed over a longer period of time and service life of the pinion shift device for the starter can be prolonged.

Furthermore, overflow or exhaustion of grease filled in the portions loosely fitting with each other under a high-temperature atmosphere can be suppressed regardless of the direction in which the starter is mounted, making it possible to increase the degree of freedom in mounting of the starter.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A pinion shift device for a starter comprising a unidirectional clutch having a clutch body and a clutch sleeve being integral with said clutch body and slidably fitted over an output shaft of an electric motor, and a shift lever swingably supported at its intermediate portion and having a two-forked portion, said shift lever pushing said clutch sleeve to move in the axial direction so that said pinion is brought into mesh with a ring gear of an engine, wherein said pinion shift device further comprises:

(a) a shift flange provided on said clutch sleeve to define an axial gap between said clutch body and said shift flange;

(b) a semicircular ring-shaped shift plate loosely fitted in said axial gap;

(c) fitting means including a projection and a hole provided on said two-forked portion of said shift lever and said shift plate and pivotably connecting said shift plate to ends of said two-forked portion; and (d) at least one sloped surface formed as an assembling guide in said fitting means to function as a guide when said shift plate is fitted to the ends of said two-forked portion.

2. A pinion shift device for a starter according to claim 1, wherein said sloped surface is formed in each of an end face of said projection and a side face around said hole.

3. A pinion shift device for a starter according to claim 2, wherein the sloped surface in the end face of said projection and the sloped surface in the side face around said hole are formed to incline in the same direction in a position that results by turning said shift plate 180 degrees from a position where said shift plate is loosely fitted in said axial gap between said shift flange and said clutch body, but in opposite directions in said loosely fitted position.

4. A pinion shift device for a starter according to claim 1, wherein at least one of the two-forked portion of said shift lever and said shift plate is molded using resin.

5. A pinion shift device for a starter according to claim 1, further comprising lubricating means provided in at least one of paired opposite side faces between said semicircular ring-shaped shift plate and said clutch body as well as said shift flange to store a lubricant therein.

6. A pinion shift device for a starter according to claim 5, wherein said shift plate is molded using resin and said lubricating means includes at least one recessed groove formed in said shift plate.

7. A pinion shift device for a starter according to claim 6, wherein said recessed groove has a semicircular ring shape in conformity with the side face of said shift plate.

8. A pinion shift device for a starter comprising a unidirectional clutch having a clutch body and a clutch sleeve being integral with said clutch body and slidably fitted over an output shaft of an electric motor, and a shift lever swingably supported at its intermediate portion and having a two-forked portion, said shift lever pushing said clutch sleeve to move in the axial direction so that said pinion is brought into mesh with a ring gear of an engine, wherein said pinion shift device further comprises:

(a) a shift flange provided on said clutch sleeve to define an axial gap between said clutch body and said shift flange;

(b) a semicircular ring-shaped shift plate pivotably connected to ends of the two-forked portion of said shift lever and loosely fitted in said axial gap; and (c) lubricating means provided in at least one of paired opposite side faces between said semicircular ring-shaped shift plate and said clutch body as well as said shift flange to store a lubricant therein.

9. A pinion shift device for a starter according to claim 8, wherein said shift plate is molded using resin and said lubricating means includes at least one recessed groove formed in said shift plate.

10. A pinion shift device for a starter according to claim 9, wherein said recessed groove has a semicircular ring shape in conformity with the side face of said shift plate.

11. A pinion shift device for a starter comprising a unidirectional clutch having a clutch body and a clutch sleeve being integral with said clutch body and slidably fitted over an output shaft of an electric motor, and a shift lever swingably supported at its intermediate portion, said shift lever pushing said clutch sleeve to move in the axial direction so that said pinion is brought into mesh with a ring gear of an engine, wherein said pinion shift device further comprises:

(a) a shift flange provided on said clutch sleeve to define an axial gap between said clutch body and said shift flange;

(b) a semicircular ring-shaped shift plate made of resin and loosely fitted in said axial gap;

(c) a two-forked portion made of resin and constituting a part of said shift lever;

(d) fitting means including a projection and a hole provided on said resin-made shift plate and said resin-made two-forked portion and pivotably connecting said shift plate to ends of said two-forked portion;

(e) sloped surfaces formed as assembling guides in an end face of said projection and in a side face around said hole, respectively, to function as guides when said shift plate is fitted to the ends of said two-forked portion; and (f) lubricating means provided in side faces of said resin-made shift plate facing said clutch body and said shift flange, respectively, to store a lubricant therein.

12. A shift lever assembly for use in a pinion shift device for a starter having a unidirectional clutch with a clutch body and a clutch sleeve being integral with said clutch body and slidably fitted over an output shaft of an electric motor, and a shift lever swingably supported at its intermediate portion and having a two-forked portion, said shift lever pushing said clutch sleeve to move in the axial direction so that said pinion is brought into mesh with a ring gear of an engine, said shift lever assembly comprising:

(a) a shift flange provided on said clutch sleeve to define an axial gap between said clutch body and said shift flange;

(b) a semicircular ring-shaped shift plate loosely fitted in said axial gap;

(c) fitting means including a projection and a hole provided on said two-forked portion of said shift lever and said shift plate and pivotably connecting said shift plate to ends of said two-forked portion; and (d) at least one sloped surface formed as an assembling guide in said fitting means to function as a guide when said shift plate is fitted to the ends of said two-forked portion.

13. A shift lever assembly according to claim 12, wherein said sloped surface is formed in each of an end face of said projection and a side face around said hole.

14. A method of assembling a pinion shift device for a starter comprising a unidirectional clutch having a clutch body, a clutch sleeve being integral with said clutch body and slidably fitted over an output shaft of an electric motor, and a shift flange provided on said clutch sleeve to define an axial gap between said clutch body and said shift flange; a shift lever swingably supported at its intermediate portion and having a two-forked portion; and a semicircular ring-shaped shift plate pivotably connected to ends of the two-forked portion of said shift lever and loosely fitted in said axial gap, said shift lever pushing said clutch sleeve to move in the axial direction through said shift flange so that said pinion is brought into mesh with a ring gear of an engine, wherein said method comprises the steps of:

(a) preparing, as said shift lever and said shift plate, a shift lever and a shift plate that have fitting means including of a projection and a hole adapted to pivotably connect said shift lever and said shift plate to each other at the ends of the two-forked portion of said shift lever and also have at least one sloped surface formed as an assembling guide in said fitting means;

(b) pressing said shift plate into said shift lever until said projection is accommodated in said hole under guide of said sloped surface, while sliding an end face of said projection along a side face around said hole, in a first position resulted by turning said shift plate 180 degrees from a position where said shift plate is loosely fitted in said axial gap between said shift flange and said clutch body;

(c) turning said shift plate 180 degrees from said first position to a second position; and (d) loosely fitting said shift plate in the axial gap between said shift flange and said clutch body while keeping said second position.

15. A method of assembling a pinion shift device for a starter according to claim 14, wherein resin is used as material of at least one of said shift lever and said shift plate.

* * * * *